US009236695B2

(12) United States Patent
Hoshiba et al.

(10) Patent No.: US 9,236,695 B2
(45) Date of Patent: Jan. 12, 2016

(54) COAXIAL CONNECTOR

(71) Applicant: MURATA MANUFACTURING CO., LTD., Kyoto-fu (JP)

(72) Inventors: Hiroyuki Hoshiba, Nagaokakyo (JP); Yukihiro Kitaichi, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 79 days.

(21) Appl. No.: 14/174,662

(22) Filed: Feb. 6, 2014

(65) Prior Publication Data

US 2014/0227906 A1 Aug. 14, 2014

(30) Foreign Application Priority Data

Feb. 8, 2013 (JP) ..... 2013-022988

(51) Int. Cl.

| | |
|---|---|
| ***H01R 9/05*** | (2006.01) |
| ***H01R 24/46*** | (2011.01) |
| *H01R 103/00* | (2006.01) |
| *H01R 13/703* | (2006.01) |
| *H01R 24/50* | (2011.01) |

(52) U.S. Cl.

CPC ..... *H01R 24/46* (2013.01); *H01R 13/7031* (2013.01); *H01R 24/50* (2013.01); *H01R 2103/00* (2013.01)

(58) Field of Classification Search

USPC ..... 439/63, 944, 66, 83, 246, 188, 578, 581

See application file for complete search history.

(56) References Cited

U.S. PATENT DOCUMENTS

| | | | | |
|---|---|---|---|---|
| 6,068,499 | A | 5/2000 | Kuriyama et al. | |
| 6,393,698 | B1 | 5/2002 | Kuriyama et al. | |
| 6,666,699 | B2 * | 12/2003 | Uratani | 439/188 |
| 6,751,317 | B2 * | 6/2004 | Shima et al. | 379/438 |
| 6,761,571 | B2 * | 7/2004 | Hida | 439/188 |
| 6,932,615 | B1 * | 8/2005 | Yeo | 439/63 |
| 7,217,137 | B1 * | 5/2007 | Nakagawa | 439/63 |
| 8,066,516 | B2 * | 11/2011 | Hoshiba et al. | 439/63 |

(Continued)

FOREIGN PATENT DOCUMENTS

| | | |
|---|---|---|
| CN | 1304193 A | 7/2001 |
| CN | 1335735 A | 2/2002 |
| CN | 101765947 B | 9/2012 |

(Continued)

OTHER PUBLICATIONS

An Office Action; "Notice of Reasons for Rejection," issued by the Japanese Patent Office on Dec. 24, 2014, which corresponds to Japanese Patent Application No. 2013-022988 and is related to U.S. Appl. No. 14/174,662; with English language translation.

*Primary Examiner* — Abdullah Riyami
*Assistant Examiner* — Harshad Patel
(74) *Attorney, Agent, or Firm* — Studebaker & Brackett PC

(57) ABSTRACT

In a coaxial connector, a body part includes an upper surface, a bottom surface, a side surface, and a hole provided in the upper surface so that a substantially rodlike probe is to be inserted therein from an upper side. A fixed terminal is fixed to the body part. A movable terminal includes a lead portion disposed on the side surface, a fixed portion bent relative to the lead portion to extend in a horizontal direction and fixed to the body part, and a leaf spring portion bent relative to the lead portion to extend in the horizontal direction and contacting the fixed terminal from a lower side. The leaf spring portion is separated from the fixed terminal when pressed down by the probe.

4 Claims, 7 Drawing Sheets

(56) References Cited

U.S. PATENT DOCUMENTS

| | | | | |
|---|---|---|---|---|
| 8,113,857 | B1 * | 2/2012 | Huang | 439/188 |
| 2001/0050983 | A1 | 12/2001 | Shima et al. | |
| 2002/0009912 | A1 | 1/2002 | Uratani | |
| 2010/0130028 | A1 | 5/2010 | Hoshiba et al. | |
| 2010/0227481 | A1 * | 9/2010 | Liao et al. | 439/63 |

FOREIGN PATENT DOCUMENTS

| | | | |
|---|---|---|---|
| JP | H10-3968 | A | 1/1998 |
| JP | 2004-031087 | A | 1/2004 |
| JP | 2010-003413 | A | 1/2010 |
| JP | 4442719 | B2 | 3/2010 |
| JP | 2012-248315 | A | 12/2012 |

* cited by examiner

COAXIAL CONNECTOR

CROSS REFERENCE TO RELATED APPLICATION

This application claims benefit of priority to Japanese Patent Application No. 2013-022988 filed on Feb. 8, 2013, the entire content of which is incorporated herein by reference.

TECHNICAL FIELD

The present technical field relates to a coaxial connector, and more particularly, to a coaxial connector that switches a signal path.

BACKGROUND

For example, Japanese Patent No. 4442719 discloses a coaxial connector. FIG. 9 is an exploded perspective view of a coaxial connector 500 described in Japanese Patent No. 4442719. In FIG. 9, a vertical direction is defined as a z-axis direction, a direction in which a movable terminal 508 and a fixed terminal 510 are arranged is defined as an x-axis direction, and a direction orthogonal to the x-axis direction and the z-axis direction is defined as a y-axis direction.

As illustrated in FIG. 9, the coaxial connector 500 includes an external terminal 502, an upper case 504, a lower case 506, a movable terminal 508, and a fixed terminal 510. The external terminal 502 is formed of a conductive material, and is kept at a ground potential. The upper case 504 and the lower case 506 are formed of an insulating material such as resin, and constitute a body part of the coaxial connector 500. The external terminal 502, the upper case 504, and the lower case 506 are stacked in this order from a +z-axis direction side toward the −z-axis direction side.

The movable terminal 508 and the fixed terminal 510 are disposed between the upper case 504 and the lower case 506. The movable terminal 508 contacts the fixed terminal 510 from a lower side. When an unillustrated probe is inserted through a hole provided in the upper case 504, it presses the movable terminal 508 down. The movable terminal 508 and the fixed terminal 510 are thereby separated from each other.

In the coaxial connector 500 described in Japanese Patent No. 4442719, it is difficult to achieve both enhancement of durability of the movable terminal 508 and size reduction of the coaxial connector 500. More specifically, when the movable terminal 508 is pressed by the probe, it elastically deforms and separates from the fixed terminal 510. To enhance durability of the movable terminal 508, it is preferable to increase the amount by which the movable terminal 508 can be displaced by elastic deformation. Therefore, it is desirable that the movable terminal 508 is long. However, when the length of the movable terminal 508 is increased, the size of the coaxial connector 500 is increased.

SUMMARY

Accordingly, it is an object of the present disclosure to provide a coaxial connector that can enhance durability of a movable terminal and can reduce the size of the coaxial connector.

A coaxial connector according to a preferred embodiment of the present disclosure includes a body part having an upper surface, a bottom surface, a side surface, and a hole provided in the upper surface so that a substantially rodlike probe is to be inserted therein from an upper side, a fixed terminal fixed to the body part, and a movable terminal including a lead portion disposed on the side surface, a fixed portion bent toward the body part relative to the lead portion and fixed to the body part, and a leaf spring portion bent relative to the lead portion to extend toward the fixed terminal and contacting the fixed terminal from a lower side. The leaf spring portion is separated from the fixed terminal when pressed down by the probe.

According to the preferred embodiment of the present disclosure, durability of the movable terminal can be enhanced, and the size of the coaxial connector can be reduced.

Other features, elements, characteristics and advantages of the present disclosure will become more apparent from the following detailed description of preferred embodiments of the present disclosure with reference to the attached drawings.

DETAILED DESCRIPTION

A coaxial connector according to an embodiment of the present disclosure will be described below with reference to the drawings.

Figure 1:
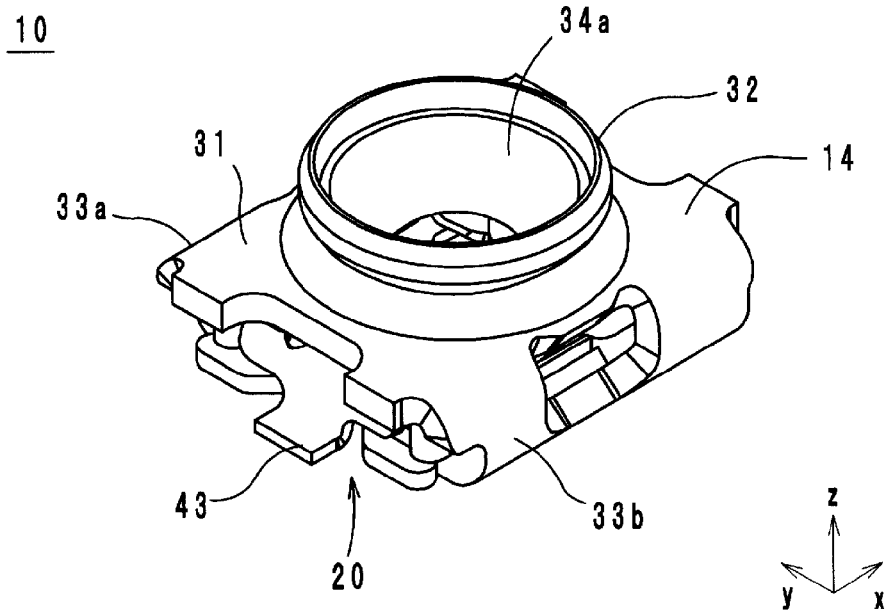
FIG. 1 is an external perspective view of a coaxial connector according to an embodiment of the present disclosure.
Figure 2:
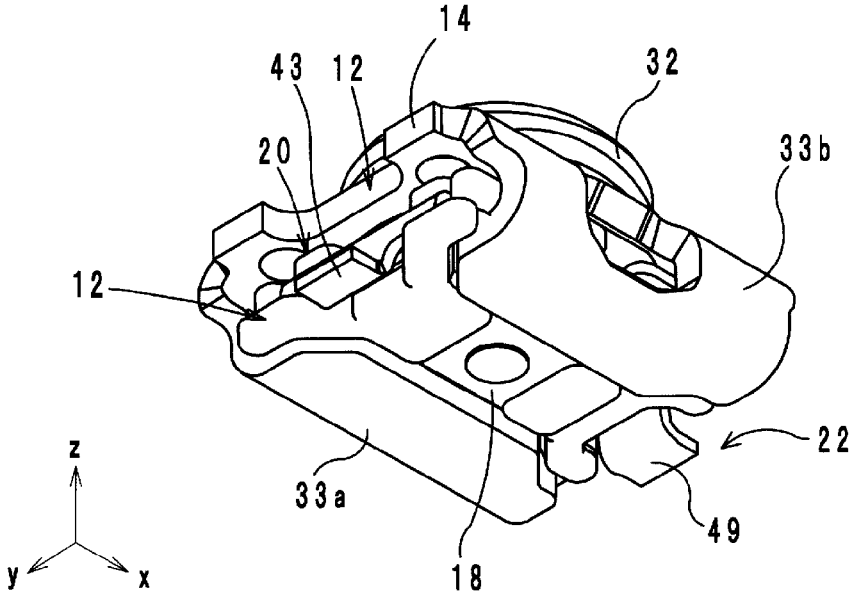
FIG. 2 is an external perspective view of the coaxial connector of the embodiment.
Figure 3:
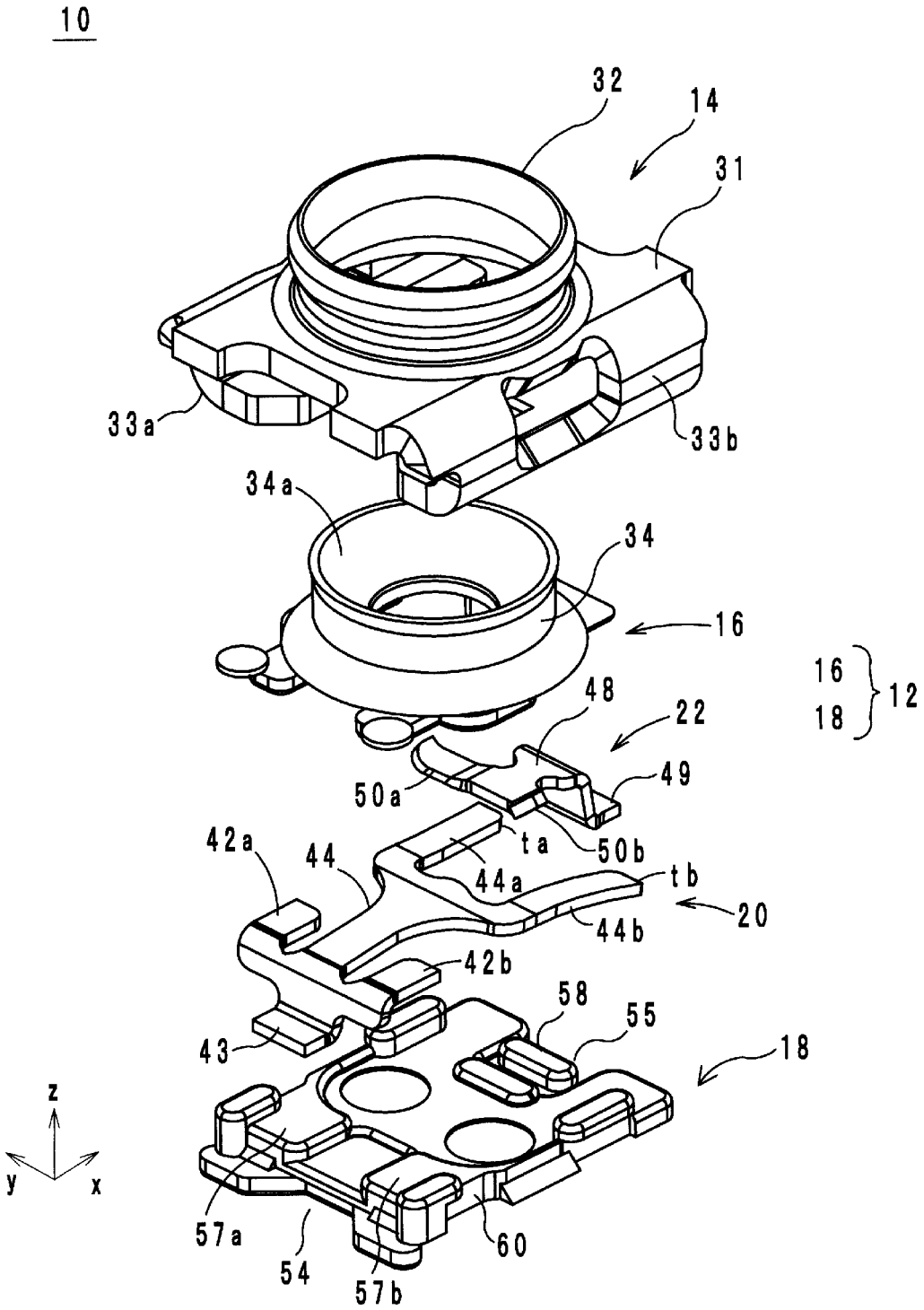
FIG. 3 is an exploded perspective view of the coaxial connector.
Figure 4:
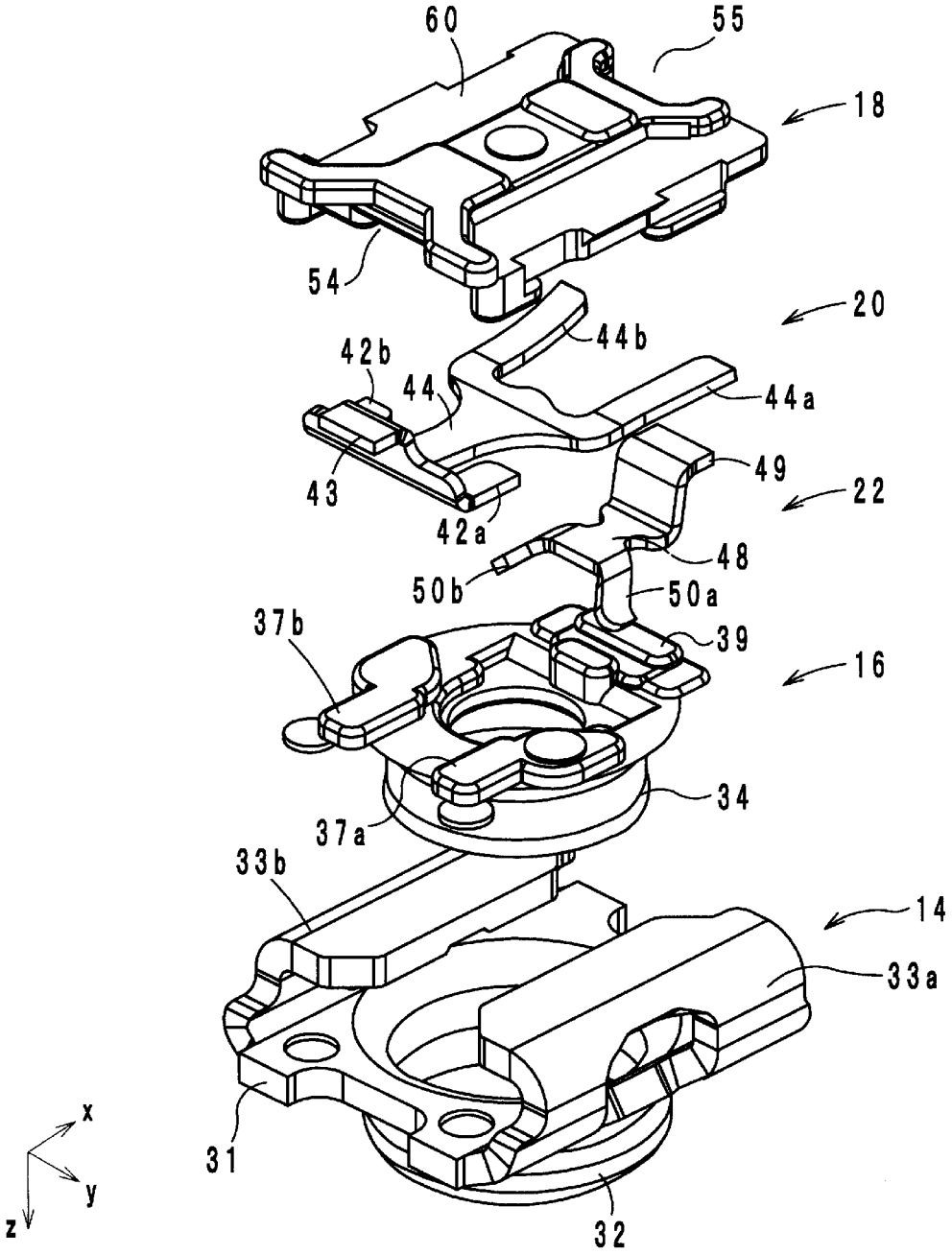
FIG. 4 is an exploded perspective view of the coaxial connector, inverted from FIG. 3.

FIGS. 1 and 2 are external perspective views of a coaxial connector 10 according to an embodiment of the present disclosure. FIGS. 3 and 4 are exploded perspective views of the coaxial connector 10. In FIGS. 1 to 4, a direction in which an external terminal 14, an upper case 16, and a lower case 18 are superposed on one another is defined as a z-axis direction. A direction from the lower case 18 toward the external terminal 14 is a +z-axis direction. A direction in which a movable terminal 20 and a fixed terminal 22 are arranged is defined as an x-axis direction, and a direction orthogonal to the x-axis direction and the z-axis direction is defined as a y-axis direction. A direction from the movable terminal 20 toward the fixed terminal 22 is a +x-axis direction.

As illustrated in FIGS. 1 to 4, the coaxial connector 10 includes a body part 12, an external terminal 14, a movable terminal 20, and fixed terminal 22, and has dimensions of about 1.2 mm×about 1.4 mm×about 0.65 mm. As illustrated in FIG. 2, the body part 12 is shaped such that a cylinder is attached to a substantially rectangular flat plate, and has an upper surface, a bottom surface, and side surfaces. The upper surface includes +z-axis direction surfaces of the cylindrical portion and the flat plate portion of the body part 12. The bottom surface is a −z-axis direction surface of the flat plate portion of the body part 12. The side surfaces are located on both x-axis direction sides and both y-axis direction sides of the flat plate portion of the body part 12. The body part 12 includes an upper case 16 and a lower case 18.

As illustrated in FIG. 3, the lower case 18 is substantially rectangular, and forms the flat plate portion of the body part 12. The lower case 18 includes a base portion 60 and fixing portions 57*a*, 57*b*, and 58. The base portion 60 is a plate member that is substantially rectangular when viewed in plan from the z-axis direction. At the centers of two sides of the base portion 60 extending in the y-axis direction, substantially rectangular cutouts 54 and 55 are disposed so that the movable terminal 20 and the fixed terminal 22 are led outside therefrom.

The fixing portions 57*a* and 57*b* are substantially flat faces that are disposed on a +z-axis direction side principal surface of the base portion 60 to fix the movable terminal 20. The fixing portion 57*a* is disposed near a +y-axis end portion of a −x-axis direction side of the base portion 60. The fixing portion 57*b* is disposed near a −y-axis end portion of the −x-axis direction side of the base portion 60.

The fixing portion 58 is a substantially flat face disposed on the +z-axis direction side principal surface of the base portion 60 to fix the fixed terminal 22. The fixing portion 58 is disposed near the center in the y-axis direction of a +x-axis direction side of the base portion 60. That is, the fixing portion 58 is disposed on a −x-axis direction side of the cutout 55.

As illustrated in FIG. 4, the upper case 16 is substantially cylindrical, and forms a part of the flat plate portion and the cylindrical portion of the body part 12. The upper case 16 includes a cylindrical portion 34 and fixing portions 37*a*, 37*b*, and 39. The cylindrical portion 34 is a substantially cylindrical member extending in the z-axis direction, and has a substantially mortar-shaped opening on a +z-axis side thereof. The cylindrical portion 34 has a hole 34*a* having a substantially circular cross section along the x-y plane. Thus, the hole 34*a* is disposed on an upper side of the body part 12. The hole 34*a* penetrates the upper case 16. A probe of a mating coaxial connector is inserted in the hole 34*a* from the substantially mortar-shaped opening.

The fixing portions 37*a* and 37*b* are flat faces disposed in a −z-axis end portion of the cylindrical portion 34 to fix the movable terminal 20. The fixing portion 37*a* is disposed at a position opposed to the fixing portion 57*a*. Thus, the fixing portion 37*a* clamps and fixes the movable terminal 20 in cooperation with the fixing portion 57*a* when the coaxial connector 10 is assembled. The fixing portion 37*b* is disposed at a position opposed to the fixing portion 57*b*. Thus, the fixing portion 37*b* clamps and fixes the movable terminal 20 in cooperation with the fixing portion 57*b* when the coaxial connector 10 is assembled.

The fixing portion 39 is a flat face disposed in a −z-axis end portion of the cylindrical portion 34 to fix the fixed terminal 22. The fixing portion 39 is disposed at a position opposed to the fixing portion 58. Thus, the fixing portion 39 clamps and fixes the fixed terminal 22 in cooperation with the fixing portion 58 when the coaxial connector 10 is assembled.

Figure 5:
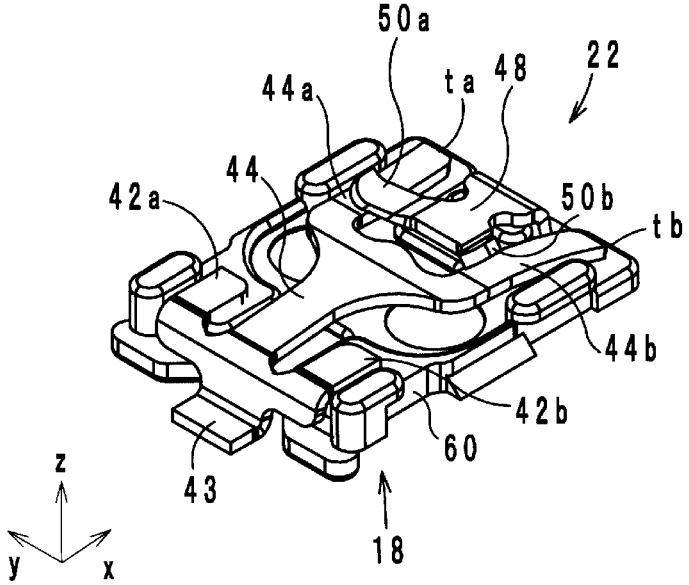
FIG. 5 is an external perspective view illustrating a state in which a movable terminal and a fixed terminal are attached to a lower case.
Figure 6:
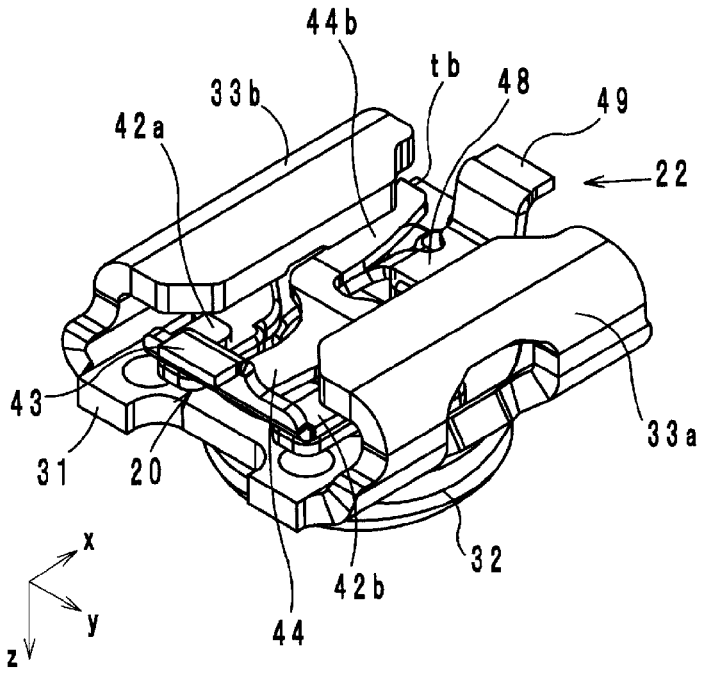
FIG. 6 is an external perspective view illustrating a state in which the movable terminal and the fixed terminal are attached to an upper case.

Next, the movable terminal 20 and the fixed terminal 22 will be described with reference to FIGS. 1 to 6. FIG. 5 is an external perspective view illustrating a state in which the movable terminal 20 and the fixed terminal 22 are attached to the lower case 18. FIG. 6 is an external perspective view illustrating a state in which the movable terminal 20 and the fixed terminal 22 are attached to the upper case 16.

The fixed terminal 22 is formed by punching and bending a flat metal plate. As illustrated in FIGS. 3 and 4, the fixed terminal 22 includes a fixed portion 48, a lead portion 49, and contact portions 50*a* and 50*b*. The fixed portion 48 is a flat portion to be fixed to the body part 12 by being clamped between the fixing portion 39 and the fixing portion 58 when the coaxial connector 10 is assembled. The lead portion 49 is bent in the −z-axis direction relative to the fixed portion 48, and is disposed on a +x-axis side surface of the body part 12. Further, a distal end of the lead portion 49 is bent in the +x-axis direction. Thus, as illustrated in FIGS. 2 and 6, the lead portion 49 is exposed to the outside of the body part 12 from the cutout 55 when the coaxial connector 10 is assembled.

As illustrated in FIGS. 4 and 5, the contact portions 50*a* and 50*b* protrude from the fixed portion 48 in +y-axis and −y-axis directions, respectively, and are bent in the +z-axis direction relative to the fixed portion 48. The contact portions 50*a* and 50*b* are in contact with the movable terminal 20 at parts facing in the −z-axis direction. Two contact portions, that is, the contact portions 50*a* and 50*b* are provided in correspondence with below-described branch portions 44*a* and 44*b*, respectively. Bending lines between the contact portions 50*a* and 50*b* and the fixed portion 48 are substantially parallel to the x-axis direction.

The movable terminal 20 is formed by punching a metal plate having springiness into a predetermined shape and bending the metal plate. As illustrated in FIGS. 3 and 4, the movable terminal 20 includes fixed portions 42*a* and 42*b*, a lead portion 43, and a leaf spring portion 44. The lead portion 43 is disposed on a −x-axis side surface of the body part 12. A distal end of the lead portion 43 is bent in the −x-axis direction. Hence, as illustrated in FIGS. 1 and 5, the lead portion 43 is exposed to the outside of the body part 12 from the cutout 54 when the coaxial connector 10 is assembled.

The fixed portion 42*a* is bent in the +x-axis direction relative to the lead portion 43 to extend toward the body part 12 in the x-axis direction (horizontal direction). The fixed portion 42*a* is a flat portion to be fixed to the body part 12 by being clamped between the fixing portion 37*a* and the fixing portion 57*a* when the coaxial connector 10 is assembled.

The fixing portion 42*b* is bent in the +x-axis direction relative to the lead portion 43 to extend toward the body part 12 in the x-axis direction (horizontal direction). The fixing portion 42*b* is a flat portion to be fixed to the body part 12 by being clamped between the fixing portion 37*b* and the fixing portion 57*b* when the coaxial connector 10 is assembled.

As illustrated in FIG. 3, the leaf spring portion 44 is bent in the +x-axis direction relative to the lead portion 43 to linearly extend in the x-axis direction (horizontal direction) from the lead portion 43 toward the fixed terminal 22 between the upper case 16 and the lower case 18. The leaf spring portion 44 contacts the fixed terminal 22 from the −z-axis direction side, and more particularly, contacts the contact portions 50*a* and 50*b* of the fixed terminal 22. Further, distal ends ta and tb of the leaf spring portion 44 are in contact with the lower case 18, and are slidable on the lower case 18. More specifically, the leaf spring portion 44 is bifurcated to include branch portions 44*a* and 44*b* provided on a side of the distal ends ta and tb (on a +x-axis direction side). The fixed terminal 22 is located between the branch portions 44*a* and 44*b*, and the contact portions 50*a* and 50*b* of the fixed terminal 22 expand in the y-axis direction as they extend in the +z-axis direction so as to be superposed on the branch portions 44*a* and 44*b*, respectively, when viewed in plan from the z-axis direction. Further, the leaf spring portion 44 entirely curves to protrude in the +z-axis direction between the distal ends ta and tb and a portion connected to the lead portion 43. For this reason, the branch portions 44*a* and 44*b* are made in pressing contact with the contact portions 50*a* and 50*b*, respectively, by the biasing force of the leaf spring portion 44. Hence, the movable terminal 20 and the fixed terminal 22 are electrically connected to each other.

The external terminal 14 is to contact an outer conductor of a mating coaxial connector, and is formed, for example, by punching, bending, and drawing a metal plate of stainless steel such as SUS301. As illustrated in FIGS. 1 and 2, the external terminal 14 includes a flat portion 31, a cylindrical portion 32, and leg portions 33*a* and 33*b*.

The flat portion 31 is a platelike member covering the upper surface of the body part 12 from the +z-axis direction side. At both y-axis direction sides of the flat portion 31, the leg portions 33*a* and 33*b* are disposed. The leg portions 33*a* and 33*b* are formed by bending parts of platelike members extending from the flat portion 31 in the y-axis direction, and clamp and fix the upper case 16 and the lower case 18, as illustrated in FIG. 1. Further, at the center of the flat portion 31, the cylindrical portion 32 protrudes in the +z-axis direction. The cylindrical portion 32 is concentric with the cylindrical portion 34, and is to be fitted on the outer conductor of the mating coaxial connector. The external terminal 14 normally functions as a ground, and an outer surface thereof is plated, if necessary.

The coaxial connector 10 having the above-described structure is assembled as follows. As illustrated in FIG. 6, the fixed terminal 22 is positioned and attached to the upper case 16, and after that, the movable terminal 20 is positioned and attached to the upper case 16. While the leg portions 33*a* and 33*b* are bent in FIG. 6, they are actually not bent in this stage.

Next, as illustrated in FIG. 6, the external terminal 14 is attached to the upper case 16 from the +z-axis direction side. At this time, the cylindrical portion 34 is inserted in the cylindrical portion 32. After that, as illustrated in FIG. 4, the lower case 18 is stacked on the upper case 16 from the −z-axis direction side.

Finally, the leg portions 33*a* and 33*b* of the external terminal 14 are caulked, so that the coaxial connector 10 having the structure illustrated in FIGS. 1 and 2 can be obtained.

Figure 7:
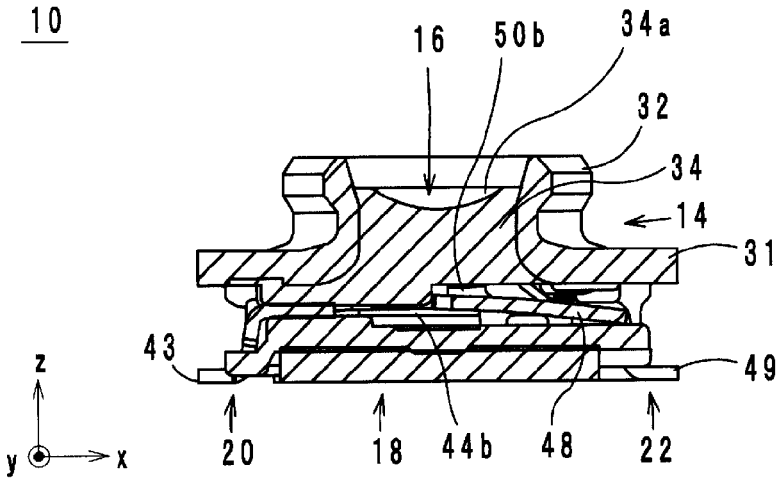
FIG. 7 is a cross-sectional structural view, taken along an x-z plane, of the coaxial connector to which a mating coaxial connector is not attached.
Figure 8:
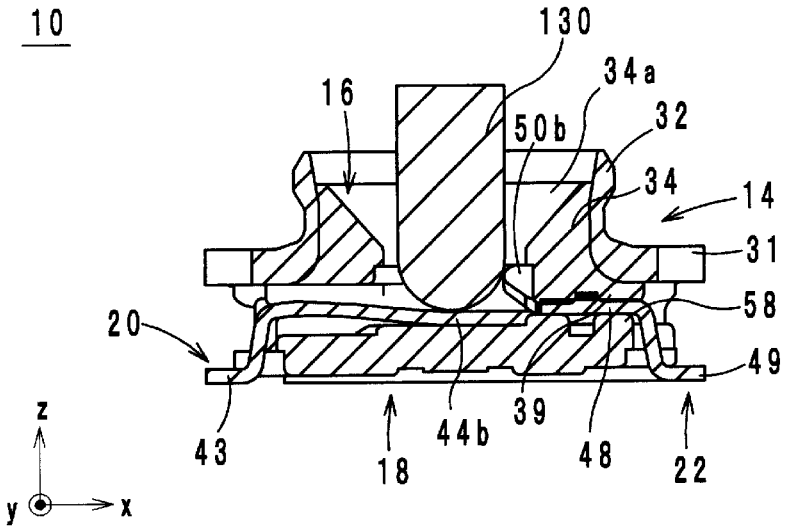
FIG. 8 is a cross-sectional structural view, taken along the x-z plane, of the coaxial connector to which the mating coaxial connector is attached.
Figure 9:
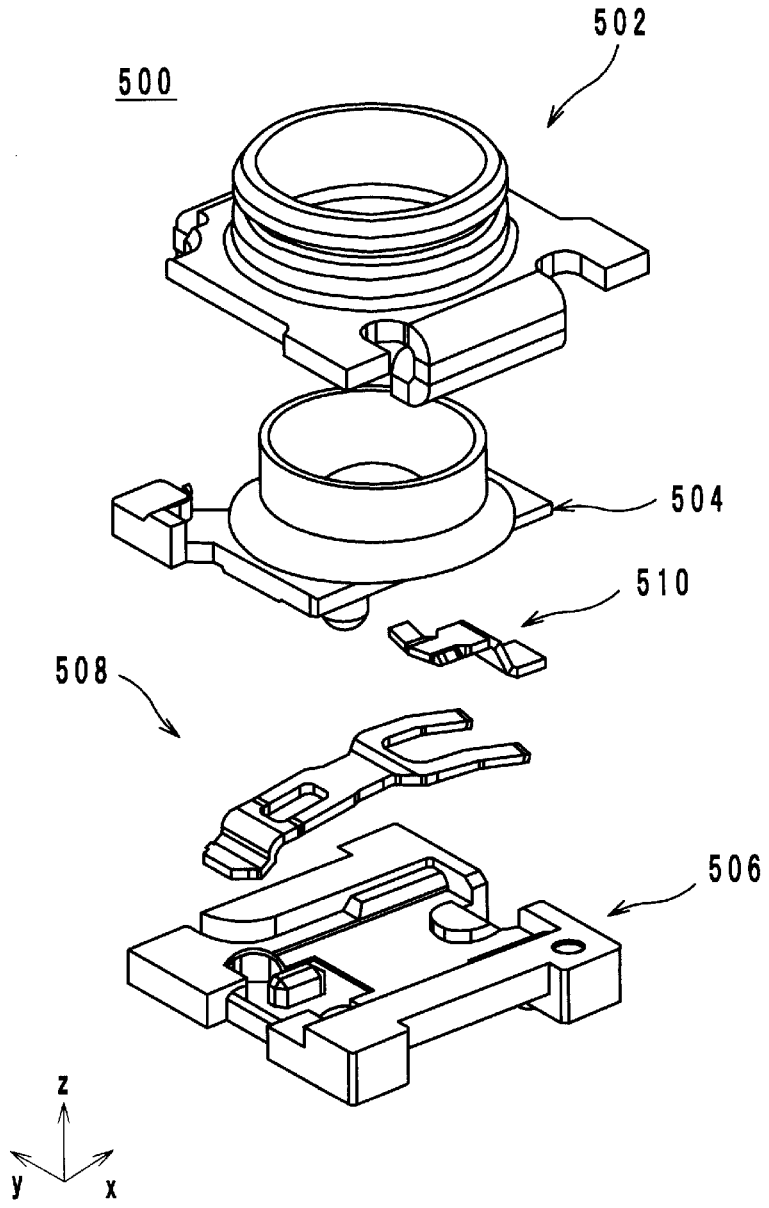
FIG. 9 PRIOR ART
FIG. 9 is an exploded perspective view of a coaxial connector described in Japanese Patent No. 4442719.

Next, the operation of the coaxial connector 10 will be described with reference to FIGS. 7 and 8. FIG. 7 is a cross-sectional structural view, taken along the x-z plane, of the coaxial connector 10 to which the mating coaxial connector is not attached. FIG. 8 is a cross-sectional structural view, taken along the x-z plane, of the coaxial connector 10 to which the mating coaxial connector is attached.

As illustrated in FIG. 7, when the mating coaxial connector is not attached, a center portion in the x-axis direction of the movable terminal 20 is bulging in the +z-axis direction. Hence, the branch portions 44*a* and 44*b* (only the branch portion 44*b* is illustrated in FIG. 7) are made in pressing contact with the contact portions 50*a* and 50*b* (only the contact portion 50*b* is illustrated in FIG. 7) by the biasing force of the leaf spring portion 44, and the movable terminal 20 and the fixed terminal 22 are electrically connected to each other.

In contrast, when the mating coaxial connector is attached, a substantially rodlike probe 130 of the mating coaxial connector is inserted through the hole 34*a* from the +z-axis direction side toward the −z-axis direction side. The probe 130 comes into contact with the leaf spring portion 44, and presses down the leaf spring portion 44 in the −z-axis direction. At this time, as illustrated in FIG. 8, the leaf spring portion 44 stretches linearly. Then, the distal ends ta and tb of the leaf spring portion 44 move in the +x-axis direction while sliding on the lower case 18. Hence, the branch portions 44*a* and 44*b* (only the branch portion 44*b* is illustrated in FIG. 8) of the leaf spring portion 44 separate from the contact portions 50*a* and 50*b* (only the contact portion 50*b* is illustrated in FIG. 8). As a result, the movable terminal 20 and the fixed terminal 22 are electrically disconnected from each other, whereas the probe 130 and the movable terminal 20 are electrically connected to each other. Simultaneously, the outer conductor (not illustrated) of the mating coaxial connector is fitted in the external terminal 14, and is also electrically connected to the external terminal 14.

When the mating coaxial connector is detached from the coaxial connector 10, the center portion in the x-axis direction of the leaf spring portion 44 moves in the +z-axis direction, as illustrated in FIG. 7. Hence, the movable terminal 20 and the fixed terminal 22 are electrically connected again, whereas the probe 130 and the movable terminal 20 are electrically disconnected from each other.

According to the coaxial connector 10 having the above-described structure, durability of the movable terminal 20 can be enhanced, and the size of the coaxial connector 10 can be reduced. More specifically, the fixed portions 42*a* and 42*b* are bent in the +x-axis direction relative to the lead portion 43 disposed on the side surface of the body part 12. The movable terminal 20 is fixed to the body part 12 with the fixed portions 42*a* and 42*b* being clamped between the upper case 16 and the lower case 18. That is, in the coaxial connector 10, the fixed portions 42*a* and 42*b* are not disposed between the lead portion 43 and the leaf spring portion 44, unlike the coaxial connector 500 described in Japanese Patent No. 4442719. Hence, the length in the x-axis direction of the coaxial connector 10 can be shorter than that of the coaxial connector 500.

Further, the leaf spring portion 44 is bent toward the fixed terminal 22 relative to the lead portion 43 disposed on the side surface of the body part 12. Thus, the entire portion of the movable terminal 20 disposed on the lower case 18 can serve as the leaf spring portion 44. From the above, the length of the leaf spring portion 44 can be increased, and durability of the movable terminal 20 can be enhanced.

According to the coaxial connector 10, the thickness of the coaxial connector 10 can be reduced. More specifically, the fixed portions 42*a* and 42*b* are bent in the +x-axis direction relative to the lead portion 43 to extend in the x-axis direction. For this reason, the thickness of the coaxial connector 10 can be made less than that of a coaxial connector in which fixing portions are not bent relative to a lead portion.

In the coaxial connector 10, as illustrated in FIG. 5, the fixed terminal 22 is located between the branch portion 44*a* and the branch portion 44*b*. That is, the distal ends ta and tb of the leaf spring portion 44 are disposed beside the fixed terminal 22 in the y-axis direction. For this reason, even when the lengths of the branch portions 44*a* and 44*b* are increased, the distal ends ta and tb of the branch portions 44*a* and 44*b* will not contact the fixed terminal 22. Hence, the branch portions 44*a* and 44*b* can have sufficient lengths, and the leaf spring portion 44 having adequate elastic force can be easily obtained. Further, since sufficient distances are ensured between the distal ends ta and tb of the branch portions 44*a* and 44*b* and the fixed terminal 22, the distal ends ta and tb are prevented from contacting the fixed terminal 22. This sufficiently isolates the movable terminal 20 and the fixed terminal 22.

OTHER EMBODIMENTS

The coaxial connector according to the present disclosure is not limited to the coaxial connector 10, and can be modified within the scope of the disclosure. While two fixed portions 42*a* and 42*b* are provided in the coaxial connector 10, a single fixed portion may be provided.

The present disclosure is useful for a coaxial connector, and in particular, is excellent in enhancing durability of the movable terminal and reducing the size of the coaxial connector.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coaxial connector comprising:

a body part having an upper surface, a bottom surface, a side surface, and a hole provided in the upper surface so that a substantially rockline probe is inserted therein from an upper side;

a fixed terminal fixed to the body part; and a movable terminal including a lead portion disposed on the side surface, a fixed portion bent toward the body part relative to the lead portion and fixed to the body part, and a leaf spring portion bent relative to the lead portion to extend toward the fixed terminal and contacting the fixed terminal from a lower side, the fixed portion being not disposed between the lead portion and the leaf spring portion, the leaf spring portion and the fixed portion being connected to only a side surface of the lead portion, and the leaf spring portion being separated from the fixed terminal when the leaf spring portion is pressed down by the probe.

2. The coaxial connector according to claim 1, wherein the body part includes a lower case and an upper case superposed on the lower case, and wherein the fixed portion is fixed to the body part by being clamped between the upper case and the lower case.

3. The coaxial connector according to claim 2, wherein the leaf spring portion extends toward the fixed terminal between the upper case and the lower case and curves to protrude upward, and wherein a distal end of the leaf spring portion is in contact with the lower case, and the distal end of the leaf spring portion slides on the lower case when the leaf spring portion is pressed down by the probe.

4. The coaxial connector according to claim 3, wherein the leaf spring portion curves between the distal end and a portion connected to the lead portion.

* * * * *